US005319714A

United States Patent [19]

McTaggart

[11] Patent Number: 5,319,714

[45] Date of Patent: Jun. 7, 1994

[54] AUDIO PHASE POLARITY TEST SYSTEM

[76] Inventor: James E. McTaggart, 21470 Rambla Vista, Malibu, Calif. 90265

[21] Appl. No.: 949,149

[22] Filed: Sep. 23, 1992

[51] Int. Cl.[5] ..... H04R 29/00

[52] U.S. Cl. ..... 381/59; 381/96

[58] Field of Search ..... 381/59, 96

[56] References Cited

U.S. PATENT DOCUMENTS 4,908,868 3/1990 McTaggart ..... 381/59

OTHER PUBLICATIONS

Tremaine, Howard M., *Audio Cyclopedia*, Howard W. Sams, 1979.

*Primary Examiner*—Curtis Kuntz
*Assistant Examiner*—Mark D. Kelly
*Attorney, Agent, or Firm*—J. E. McTaggart

[57] ABSTRACT

Instrumentation for determining audio phase polarity is directed particularly to avoiding errors commonly encountered in pulsed acoustic polarity testing due to waveform distortions such as overshoot and ringing typically introduced by loudspeaker cone resonances, etc. The acoustic signal is sensed by a test microphone, amplified and processed to provide a non-inverted and an inverted waveform which are envelope-detected and their leading edges analyzed in real time at three key levels. One of pair of latching comparators triggers at a designated level to determine the phase polarity. The result is held in register while the signal amplitude is checked. If the amplitude is found to be within a suitable working dynamic range then the registered phase polarity is indicated by a timed indication on either a red or a green LED; otherwise indication is inhibited to avoid error. Thus a user sensitivity control is not required. A special test signal generator provides a fast-rising impulse waveform repeating at one second intervals, available at a line level output port for driving amplifier inputs, and at a loudspeaker output port for direct polarity testing of loudspeakers from special battery-power-efficient drive circuitry. Options include provisions for polarity testing of microphones and for using an external test microphone on a boom to reach inaccessible speaker locations.

18 Claims, 6 Drawing Sheets

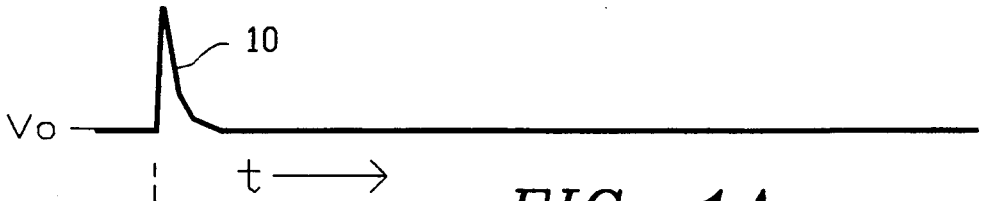
FIG. 1A
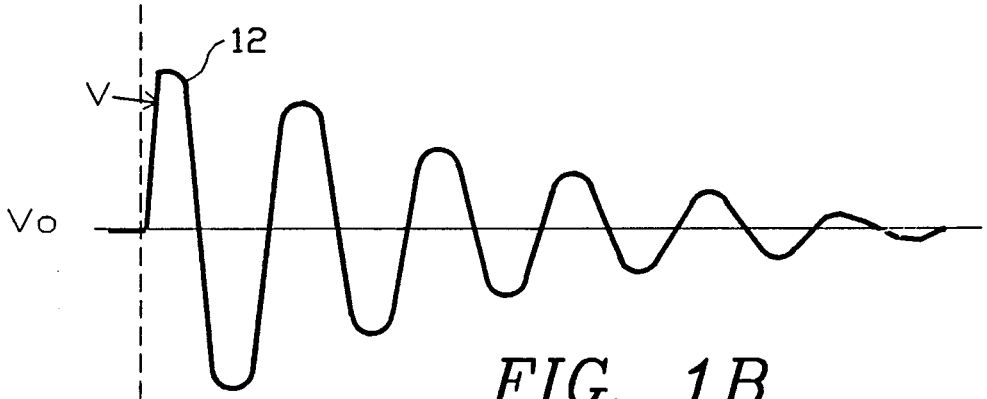
FIG. 1B
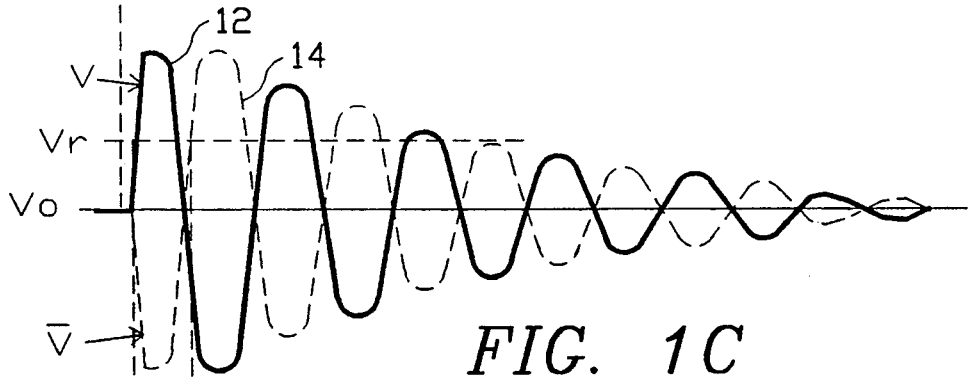
FIG. 1C
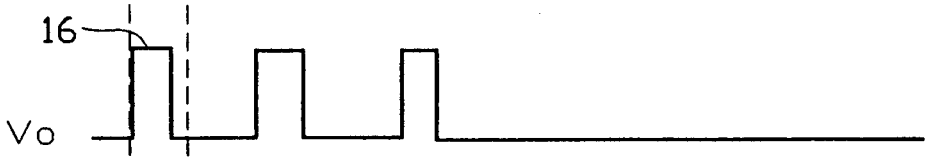
FIG. 1D
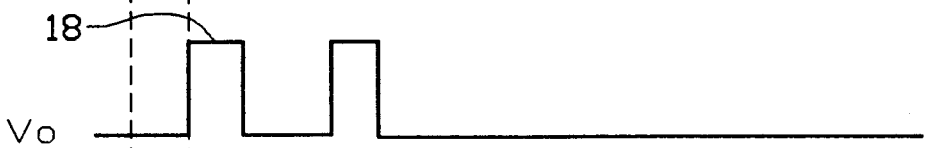
FIG. 1E
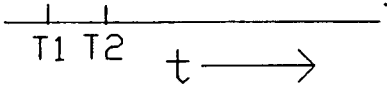

AUDIO PHASE POLARITY TEST SYSTEM

FIELD OF THE INVENTION

The present invention relates to the audio field and more particularly it relates to test apparatus and methods for determining the absolute phase polarity of an audio component or channel which may include an acoustic path.

BACKGROUND OF THE INVENTION

In the practice of audio technology there is often a need to determine the polarity of the phase relationship, i.e. whether "in phase" or "out of phase", between the input and output ports of a functional audio block such as an amplifier or an audio channel which may include several links of different media such as electrical, acoustic, modulated r.f., optical, magnetic, etc., connected in tandem.

A common requirement is to determine or verify polarity at the terminals of transducers such as loudspeakers and microphones.

Another common requirement is to determine the overall phase polarity of an audio channel including an amplifier and a loudspeaker.

Where several loudspeakers are operated together there is a need to ensure that all of the loudspeakers are operating in phase with each other to avoid cancellation and loss of acoustic efficiency and quality. This need for relative phasing applies to both monophonic and stereophonic systems, and applies generally wherever interaction may occur, for example between loudspeakers and microphones.

In professional sound activities, good practice requires at least a general observance of relative phasing to minimize the variables; however as increasingly higher levels of excellence are sought, heightened polarity awareness leads to observance of absolute phase polarity throughout an entire system as verified by polarity testing of all system components, electrical and acoustic.

DISCUSSION OF PRIOR ART

U.S. Pat. No. 4,908,868 to the present inventor discloses test instrumentation and methods for determining the relative phase polarity between two acoustic sources, and provides an overview of known practice and prior art for determining audio phase polarity.

Regarding absolute audio phase polarity, which is addressed by the present invention, Donald G. Fink in U.S. Pat. No. 3,067,297 taught the principle of stimulating the input of the channel under test with an asymmetrical impulse waveform and then determining absolute phase polarity of the channel by observing its output with an oscilloscope or a simplistic asymmetry indicator based on a reversibly-switched quasi-peak amplitude detector utilizing a vacuum tube diode. The Fink apparatus, being confined to the testing of electrical circuits, typically inter-studio wired lines, functioned adequately for that purpose, however it did not anticipate acoustic testing and thus failed to address certain inherent problems associated therewith.

The principle of the Fink patent, i.e. stimulating the unit under test from a non-symmetrical impulse and then testing simply for amplitude non-symmetry in the output, has been followed in a number of contemporary audio testing devices for checking absolute phase polarity. While this principle is easily implemented in all-electrical paths such as amplifiers, it is very vulnerable to the inclusion of acoustic paths; particularly where loudspeakers are involved, polarity detection approaches of known art frequently produce erroneous and confusing results. Thus there is a need for more sophisticated and robust polarity detection techniques; for example, inherent loudspeaker aberrations such as overshoot and ringing introduced into the acoustic waveform by the mechanical resonances in response to an impulse test signal have been found to greatly reduce or even invert the apparent asymmetry as perceived by amplitude sensing apparatus of known art depending on the particular detection circuitry utilized. Thus apparatus of known art, lacking adequate immunity and other sophistication in the detection circuitry, may often indicate the wrong phase polarity or else produce indeterminate and confusing indications such as a mixture of opposite polarity readings.

Furthermore, polarity test apparatus of prior art, especially where amplitude detection is relied upon, has generally been sensitive to variations in level of the sensed test signal, and thus vulnerable to erroneous results if the signal happens to be too weak or too strong. As a remedial measure, such apparatus is commonly equipped with a sensitivity control which must be operated judiciously by the user, thus there is a heavy dependence on skill, attention, experience and interpretation of confusing results on the part of the user.

The present invention provides innovative electronic circuit improvements for overcoming these and other hitherto unaddressed difficulties and errors in the testing of absolute phase polarity of audio equipment, particularly where the audio channel under test includes an acoustic path such as that from a loudspeaker.

OBJECTS OF THE INVENTION

It is a primary object of the present invention to provide improved test instrumentation for determining the absolute phase polarity of an audio channel which is stimulated by an asymmetrical impulse test signal.

It is a further object to provide a phase polarity sensor instrument capable of acoustic testing with minimal probability of error from loudspeaker aberrations such as overshoot and ringing.

It is a further object that the instrument be made to operate error-free over a wide dynamic operating range of the sensed signal, and that excessively weak or strong signals outside this operating range be prevented from activating the polarity indication, thus eliminating need for a user sensitivity control.

It is a further object of the present invention to provide an improved impulse test signal generator, for audio phase polarity testing, having a line output port suitable for driving an amplifier input.

It is a further object that the impulse test generator be provided with a loudspeaker output port and associated power driving circuitry capable of pulsing a loudspeaker at a viable test level.

It is a still further object to minimize battery current drain in both the analyzer and the signal generator, particularly with regard to both average and peak current demand of the loudspeaker driving circuitry.

SUMMARY OF THE INVENTION

The above and other objects and advantages have been achieved in the present invention by providing the sensor with polarity-determining circuitry in which the leading edge of a non-inverted and an inverted version of the input waveform are analyzed at three threshold voltage levels. The non-inverted and the inverted waveforms are sensed at a reference level at their rising edge by a pair of latching comparators driving a flip-flop. Upon a detection by one of the comparators, a tentative polarity determination, based on which of the two waveforms was sensed, is temporarily registered in the flip-flop, which then disregards any immediately-following sensing such as the second half cycle of a ringing waveform due to loudspeaker resonance. The waveform is then tested for sufficient peak amplitude and if this is found to have an adequate working value, the registered polarity is displayed by a visual indicator, typically a red or green LED, which is energized for a set time period, typically 0.4 seconds, controlled by a timer. Then, after checking for the waveform to have settled sufficiently, the circuit is reset ready to test the next test impulse. The test signal generator provides a narrow triangular pulse waveform repeating at one second intervals.

In addition to a line level output, a speaker output is provided for testing loudspeakers directly. A novel speaker drive circuit prolongs battery life by isolating the battery from the high peak demand for speaker current, which is supplied instead by a capacitive discharge circuit. Battery life is also prolonged by automatically removing bias power from the speaker drive transistor whenever there is no speaker connected.

BRIEF DESCRIPTION OF THE DRAWINGS

The above and further objects, features and advantages of the present invention will be more fully understood from the following description taken with the accompanying drawings in which:

FIGS. 1A-E and 2A-D are waveforms relating to theory of operation of the present invention.

DETAILED DESCRIPTION

Figures 2A, 2B, 2C, 2D:
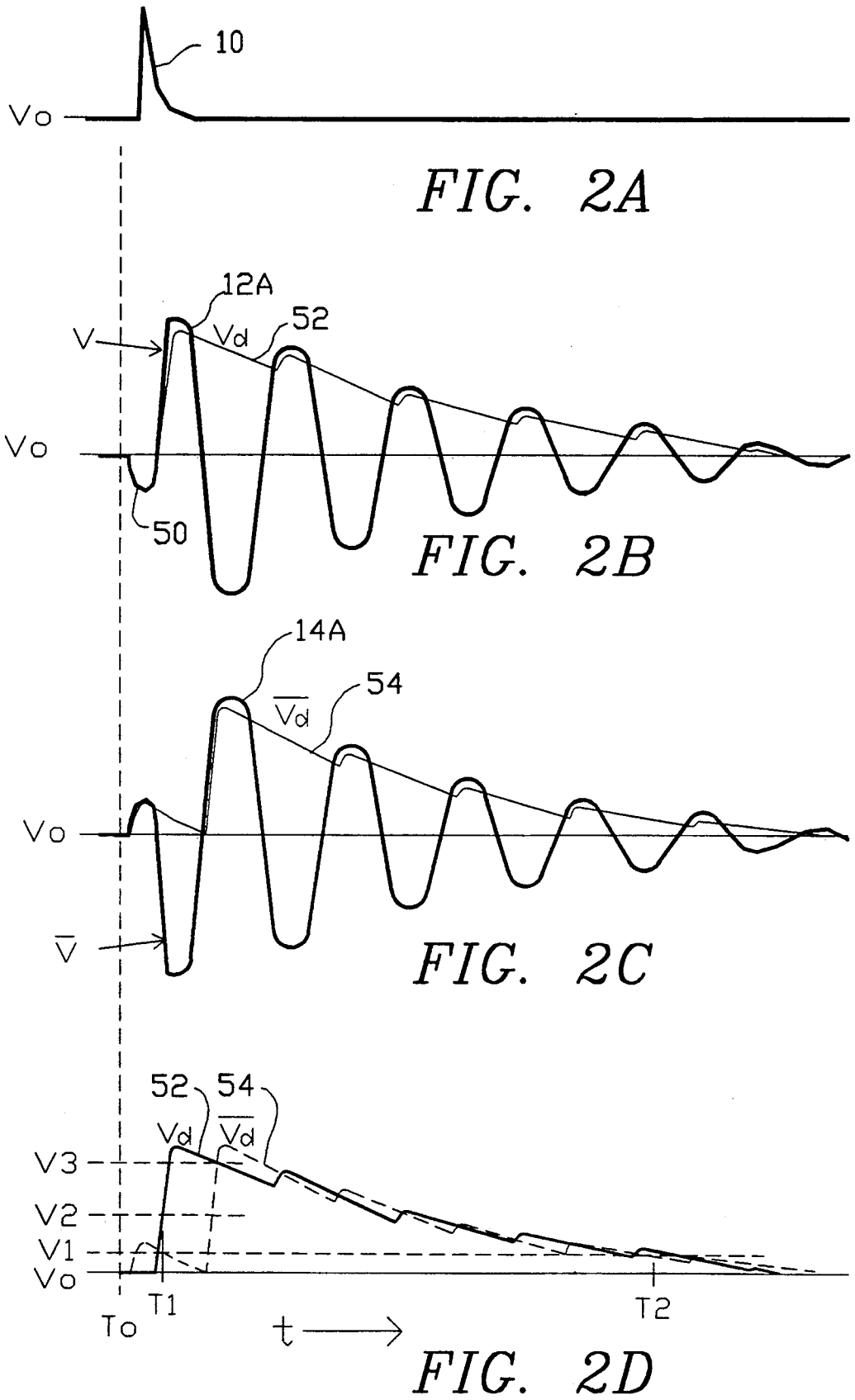

FIG. 1A depicts the waveform 10 of an impulse test signal for use in connection with the present invention. The impulse waveform 10 is seen to be approximately triangular, positive in polarity, with a relatively fast rise time and a slower, exponential decay to the zero base line. For purposes of the present invention the positive polarity and the fast rise time are key parameters, while the fall portion is non-critical. The pulse is repeated at regular intervals, typically one pulse per second.

A unit or channel under test is stimulated by applying a test signal having waveform 10 as input and then determining the polarity of the reproduced signal at the output of the unit or channel under test. If this polarity is the same polarity as that of the input (i.e. positive) then the polarity of the unit or channel under test is said to be positive (+); conversely if the output is inverted compared to the input, the polarity is said to be negative (−).

Under ideal conditions, for example where the unit under test is a low distortion wide band d.c. amplifier, the test signal would be accurately reproduced in its original form with the d.c. component preserved so that the waveform remains as shown in FIG. 4A, never crossing through the zero volts level to the negative region. In such ideal conditions, the polarity could be determined by relatively simple electronic detection means, for example by a simple voltmeter measurement or by applying the signal to a pair of oppositely polarized average or peak detectors, where a response from one detector would indicate a particular polarity and a response from the other detector would indicate the opposite polarity. Alternatively, a single detector with a DPDT reversal switch could be utilized.

In the more usual situations where the d.c. component is lost, typically due to capacitor and/or transformer coupling anywhere in the audio channel, the waveform will average itself about the zero volt baseline. However polarity analysis is still quite simple in the absence of distortion: polarity can be readily determined by comparing two amplitude detections of opposite polarity.

FIG. 1B depicts a distorted response as picked up by a microphone in front of a loudspeaker driven by an impulse waveform such as that shown in FIG. 1. Any d.c. component has been lost since the acoustic media cannot sustain a d.c. component, and due to the mechanical cone resonance of the loudspeaker, the resultant waveform 12 approximates a train of damped oscillations at the resonant frequency, usually in a range from about 30 to 200 Hz depending on the size and design of the loudspeaker. The waveform 12 is shown as having positive phase polarity, i.e. the first half cycle is in the same direction (positive) as the test pulse (waveform 10 of FIG. 1A).

It should be clear from examination of waveform 12 that attempting to determine polarity of such a waveform by any form of amplitude detection or measurement whether peak, quasi-peak or average would prove highly problematic, inconclusive and error-prone: it is not uncommon for the negative-going "overshoot", i.e. the second half cycle, to reach a greater peak amplitude than that of the first half cycle.

Waveform observation on an oscilloscope would enable polarity identification, however the present invention is directed to automatic phase polarity determination in a small hand-held analyzer which visually indicates the + or − result by the color of an energized LED.

A viable approach developed for and utilized in the present invention is based on time relationship between the leading edges of the first and second half cycle.

As opposed to determining the "polarity" of relatively undistorted unidirectional or clearly assymetrical pulse waveforms, based on amplitude sensing as taught by Fink and others, the analyzer of the present invention determines the "phase polarity" of pulse waveforms which have been grossly distorted by sinusoidal and bidirectional content, based on sensing the leading edge of the waveform in the positive and negative regions and determining phase polarity from the time priority between the two sensings.

FIG. 1C depicts waveform 12 (as in FIG. 1B) along with an inverted replica 14 of waveform 12. The two waveforms 12 and 14 are compared to a designated common reference voltage Vr by identical comparator circuits.

FIGS. 1D and 1E depict the comparator output waveforms 16 and 18 resulting from the comparisons of waveforms 12 and 14 (FIG. 1C) respectively with reference voltage Vr. It is seen that waveform 16, which is generated from waveform 12, starts earlier in time than waveform 18, which is generated from waveform 14, the time difference being a half cycle of the ringing frequency. For a speaker resonance of 100 Hz, the (half cycle) time difference between waveforms 16 and 18 will be 5 milliseconds. Electronic means may be utilized to detect which of the two waveforms 16 and 18 occurs earlier, and thus determine the phase polarity, which may then be indicated by suitable display means. However additional circuit means are required in order to register the polarity as determined from the earlier pulse 16 and to disregard the immediately following pulse 18.

FIG. 2A depicts the impulse waveform 10 once more for reference in connection with FIGS. 2B–2D.

FIGS. 2B and 2C depict respectively non-inverted and inverted damped oscillatory waveforms 12A and 14A which are responses to the test signal of FIG. 2A where the initial transient includes an appreciable amount of "preshoot" seen at portion 50 of waveform 12A in FIG. 2B. Also shown are positive-going envelopes 52 and 54 which result from quasi-lo peak detection of waveforms 12A and 14A.

Converting these signals to envelopes provides two main benefits: it provides a short time constant which can be utilized to temporarily register a sensed polarity while disregarding an immediately following sensing at the other comparator (refer to FIGS. 1D and 1E), and it eliminates negative-going portions of the waveform which could exceed the input ratings of integrated circuit comparators.

FIG. 2D shows the two detected envelopes 52 and 54 and a group of three reference voltages V1, V2 and V3.

V2 represents the main reference voltage level (corresponding to Vr in FIG. 1C) at which the initial rise of either the + or the − detected envelope is sensed to trigger the corresponding comparator.

V1 represents a release threshold voltage below which both envelopes are required to settle to unlatch the flip-flop back to its ready state for the next impulse.

V3 represents a minimum working amplitude that the envelope is required to reach to allow a polarity display. This requirement inhibits the display unless the amplitude of signal under test is found to be sufficient for reliable polarity determination, thus avoiding the need for a user sensitivity control adjustment and eliminating a number of potential causes of erroneous readings.

Figure 3:
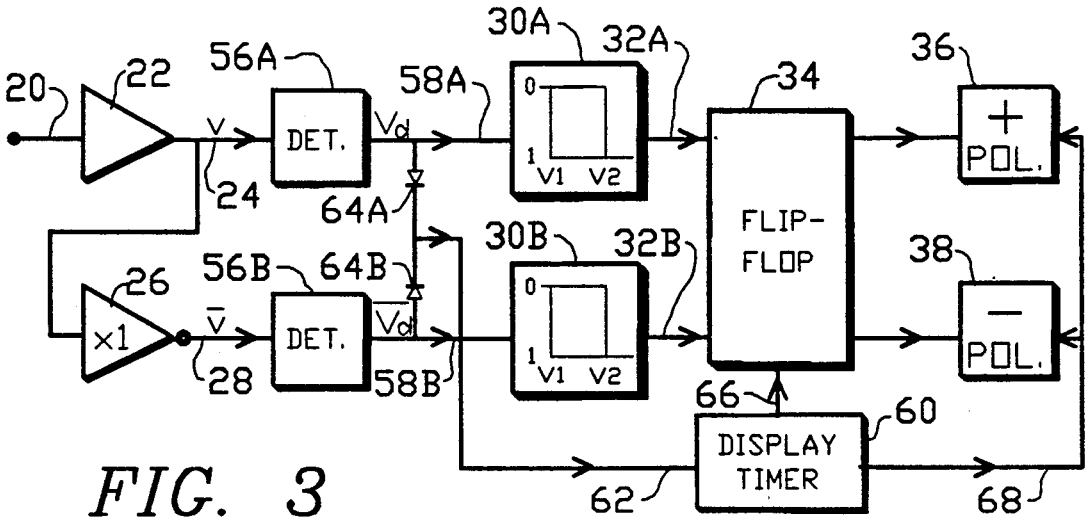
FIG. 3 is a functional block diagram of a preferred embodiment of the present invention.

FIG. 3 is a functional block diagram of electronic circuitry of a preferred embodiment of the present invention utilizing principles discussed in connection with FIGS. 2A–2D. A non-inverted signal at node 24 and an inverted signal at node 28 are derived from the signal received at input 20 from the unit under test. Typically input 20 receives the signal from a test microphone in an acoustic field of a loudspeaker under test. Amplifier 22 and inverter 26 drive a pair of active precision quasi-peak detectors 56A and 56B which provide detected envelopes (52 and 54, FIG. 2D) at nodes 58A and 58B, the inputs to comparators 30A and 30B.

Comparators 30A and 30B are made to have a hysteresis loop response as indicated, requiring at the input a trigger level V2 to toggle the output to logic 1 and requiring a release level V1, lower than V2, to toggle the output back to logic 0. Outputs of comparators 30A and 30B at nodes 32A and 32B drive a flip-flop 34 which has three stable states: (1) a ready state in which the flip-flop's outputs both remain at logic 0, holding polarity indicators 36 and 38 unenergized, with comparators 30A and 30B holding both of the flip-flop inputs 32A and 32B at logic 0, (2) a first latched state where a logic 1 from comparator 30A (with comparator 3OB's output at logic 0) latches the flip-flop so as to apply a logic 1 energizing the +polarity indicator 36 and a logic 0 inhibiting indicator 38, and (3) a second latched state where a logic 1 from comparator 30B (if comparator 30A's output is logic 0) latches the flip-flop 34 so as to apply a logic 1 energizing the − polarity indicator 38 and a logic 0 inhibiting indicator 36. The flip-flop 34 remains latched in either of the two latched states as long as the active flip-flop input is held at logic 1, regardless of the logic level of the other input, and returns to the ready state only when the active input returns to logic 0 as a result of the detected envelope input to the corresponding active comparator, 30A or 30B, settling below the release level Vi.

A display timer 60 has its trigger input node 62 connected to diodes 64A and 64B which supply to node 62 a composite envelope signal representing the higher of the two envelopes at nodes 58A and 58B at any time. When the trigger input at node 62 reaches the predetermined threshold voltage level V3, the timer 60 is initiated to drive the polarity display for a timed duration, typically 0.4 seconds, via two drive signals: a flip-flop locking signal at node 66, and a polarity display enabling signal at node 68.

Figure 4:
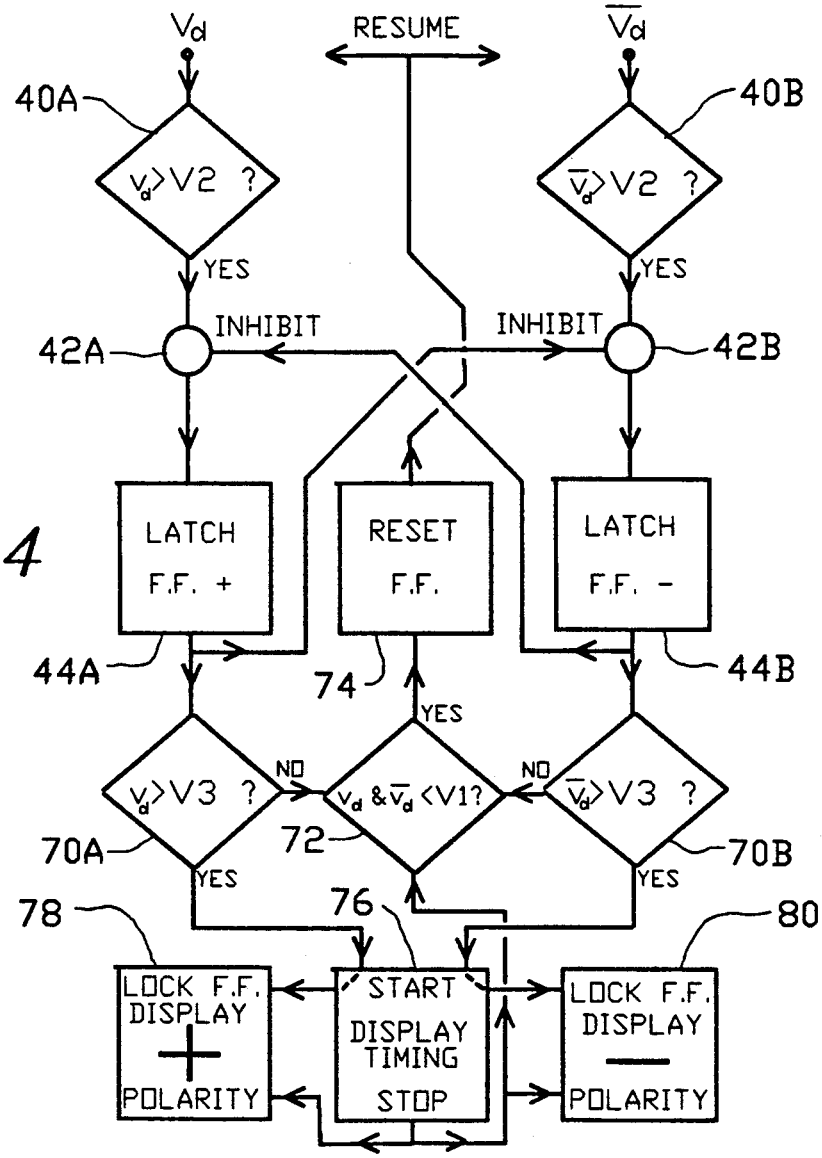
FIG. 4 is a flow diagram relating to FIGS. 1A-3.

FIG. 4 is an flow diagram of the operation of the circuitry of FIG. 3. The inputs to boxes 40A and 40B are the detected envelopes at nodes 58A and 58B (FIG. 3).

At boxes 40A and 40B a comparator output logic level transition is generated whenever the non-inverted or the inverted input respectively exceed the reference voltage Vr. Circles 42A and 42B represent enable/inhibit functions controlled from boxes 44B and 44A respectively. This cross-coupling represents the operation of flip-flop (34 FIG. 3) which disables the opposite side whenever either side becomes active; for example, in FIGS. 1D and 1E, it is desired for the flip-flop to register on the leading edge of the earlier waveform 16 and to disregard the later waveform 18. Thus a response at box 40A, transmitted through circle 42A to box 44A inhibits at circle 42B any immediately following response at box 40B from activating box 44B. Boxes 44A and 44B also progress to decision boxes 70A and 70B where the signal level check is performed, and if validated, at box 76 the + polarity display at box 78 or the − polarity display at box 80 is activated.

At comparison box 40A, in the event of the non-inverted envelope rising above threshold level V2, then the flip-flop is caused to latch to the + state at box 44A, then at comparison box 70A there are two possibilities:

(1) if the envelope amplitude fails to rise above the display threshold V3 and instead settles below release threshold V1 at box 72, the flip-flop is reset to the ready state at box 74 and the system resumes its monitoring mode at boxes 40A and 40B without any polarity indication having been displayed, or (2) if the detected envelope Vd exceeds threshold level V3, then at box 76, the display timer is started and at box 78 the flip-flop is held locked while "1+ polarity" indication is displayed for the duration of the timed interval, typically 0.4 seconds. At the end of the display time, upon determining at box 72 that the detector voltage has settled below threshold level V1, then at box 74 the flip-flop is reset to the ready state and the system resumes its monitoring mode at boxes 40A and 40B.

In acoustic testing, if there is no change in the location of the pickup microphone relative to the acoustic source, the same polarity will be indicated repeatedly: the valid polarity indicator is energized for 0.4 seconds during each one second test pulse interval, indicating the detected phase polarity by its red or green color.

The V3 threshold requirement at boxes 70A and 70B acts to prevent false indications by inhibiting any polarity display unless the peak level of the signal has sufficient working amplitude, well above the comparator triggering level V2 by a predetermined margin. Otherwise, on a marginally weak signal, if the peak amplitude of the second half cycle should happen to exceed that of the first half cycle, which is often the case, the wrong polarity indication could be triggered and displayed; instead the timer (60, FIG. 3) is prevented from initiating a display period.

The V1 threshold requirement at box 72, which represents the release level of the hysteresis loop in comparators 30A and 30B in FIG. 3, requires the composite detected envelope to settle below threshold level Vi before resetting flip-flop 34 from a latched mode to the ready mode, so as to ensure suitable signal conditions for analyzing the next test impulse. This acts to avoid false indications which could otherwise result from extraneous sounds or noise.

Figure 5:
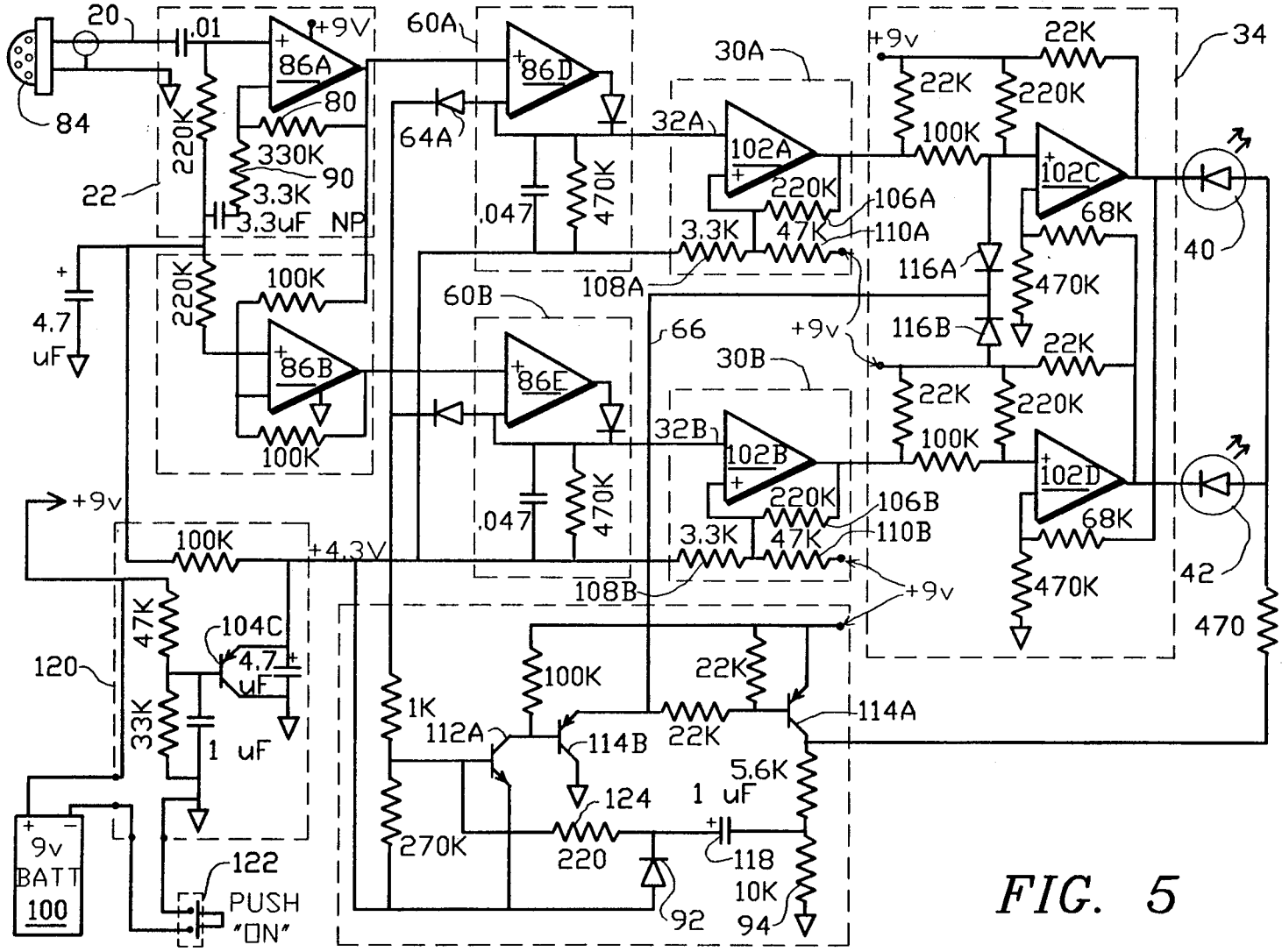
FIG. 5 is a schematic diagram relating to FIGS. 1A-4.

FIG. 5 is a schematic diagram of electronic circuitry for implementing the present invention in a preferred embodiment corresponding the descriptions above in connection with FIGS. 2A-D, 3 and 4.

A microphone 84 is connected to input 20 of non-inverting amplifier 22 utilizing op-amp 86A configured with a negative feedback divider formed from resistors 88 and 90 which set the stage voltage gain at 100 (40 db). A second op-amp 86B is configured as a unity gain inverter receiving as input the output signal from op-amp 86A, and providing as output an inverted replica of the output signal from op-amp 86A. These complementary outputs of op-amps 86A and 86B drive identical active detector circuits 60A and 60B, formed from op-amps 86C and 86D respectively. Op-amps 86A, 86B, 86C and 86D may be implemented from a type IM324 quad op-amp IC. The detector outputs are referenced to a +4.3 volt supply bus 98, the main supply being +9 volts from a battery 100.

The outputs of detectors 60A and 60B drive a pair of identical latches 30A and 30B utilizing comparators 102A and 102B with positive feedback through resistors 106A and 106B to provide hysteresis loop latching action. In a quiescent condition each latch 30A and 30B remains in an OFF state where its output is logic level 0, near +9 volts. In the presence of a signal from a detector, for example detector 60A, when the detected envelope voltage exceeds the designated trigger level V2, latch 30A is triggered to transition to the ON state where its output is logic level 1 1, near 0 volts. This ON state remains latched until the detected envelope signal level drops to a designated release level V1 (lower than V2) to return latch 30A to the OFF state. The values shown for resistors 106A, 106B, 108A, 108B, 110A and 110B set V1 at +0.24 volt and V2 at +0.35 volt (detected signal levels relative to the 4.3 volt bus 98).

Flip-flop 34 utilizes two comparators 102C and 102D, which may be implemented along with comparators 102A and 102B from a type IM339 quad comparator IC. In a quiescent state with latches 30A and 30B both unlatched, the logical 0 inputs (near +9 volts) hold the flip-flop 34 in its ready (unlatched) state with its outputs at logical 0 (near +9 volts). This prevents any energizing of LEDs 40 and 42 since their cathodes are held near +9 volts. In this state, the resistor values shown hold the inverting inputs of comparators I02B and I02C at +7.6 volts, with flip-flop 34 set to be triggered to either of its + or − latched states in response to a logic 1 input resulting from a detected envelope signal exceeding the V2 threshold level at either input 32A of latch 30A or input 32B of latch 30B.

Timer circuit 60 has a trigger input at node 62 connected to diodes 64A and 64B which combine the envelope signals from detectors 64A and 64B. As long as this combined envelope signal remains below the display-enable threshold level V3, transistor 112A, and thus transistors 114A and 114B remain biased to cutoff. Also, via node 66, diodes 116A and 116B are reverse biased so to allow the flip-flop 34 to stand by in its ready state when node 20 is quiescent. In this condition the polarity indicator LEDs 40 and 42 are held unenergized, particularly since node 68, which drives the anodes of LEDs 40 an 42, remains near zero volts with transistor 114A off. During such quiescent periods, timing capacitor 118 becomes rapidly charged up to about +4 volts through diode 92 and resistor 94, and then when transistor 112A is triggered, it is held on by capacitor 118 discharging through resistor 124 for a discharge time which sets the display time duration, typically 0.4 seconds. During this time duration, the appropriate one of the LED's 40 or 42 remains energized to display the phase polarity registered in flip-flop 34.

The detailed circuit action in response to normal test signal conditions and other conditions may be further analyzed with reference to the above descriptions in connection with FIGS. 3 and 4.

In power supply portion 120, transistor 114C regulates the +4.3 volt supply at node 98. The 9 volt battery 100 is provided with an on-off switch 122 which may be in the form of a press-to-operate pushbutton.

Figure 6:
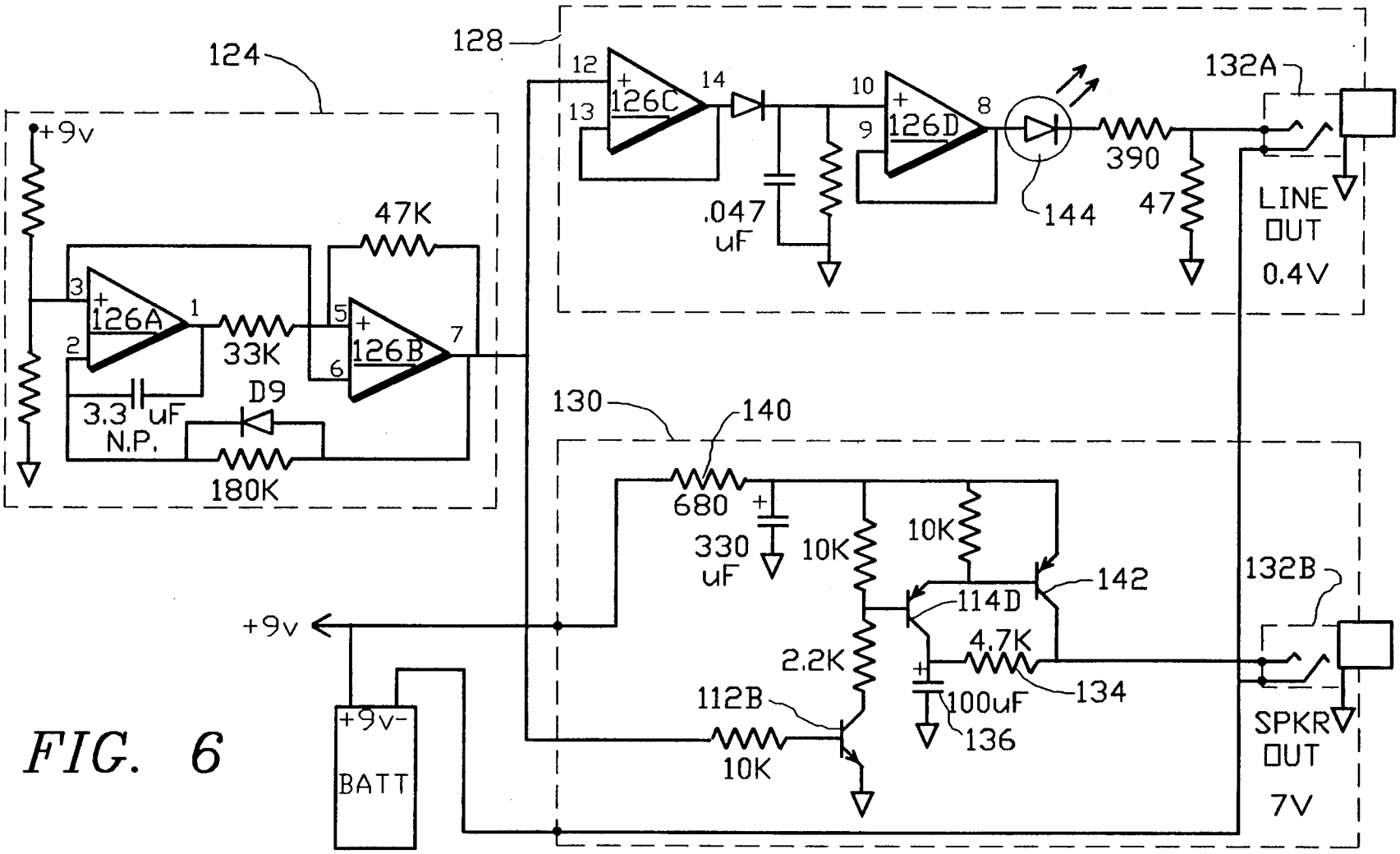
FIG. 6 is a schematic diagram of a test impulse signal generator for use in phase polarity testing according the present invention.

FIG. 6 is a schematic diagram of a test signal generator for use in phase polarity testing in accordance with the present invention. An astable multivibrator operating at 1 Hz is formed from op-amps 126A and 126B driving two output stages 128 and 130.

The line output stage 128, utilizing op-amps 126C and 126D as unity gain buffers in a wave shaping circuit provides a low source impedance line output signal of 0.4 volts peak amplitude and about 40 milliseconds duration at receptacle 132A. A pulsing visual indication is provided by LED 144, which is typically mounted through the control panel of the instrument housing.

The loudspeaker output stage utilizing transistors 112B, 114D and 142 provides a power output impulse signal of about 7 volts peak and about 1.5 milliseconds duration at receptacle 132B for driving a 4 or 8 ohm loudspeaker for acoustic testing purposes.

Receptacles 132A and 132B are of the ¼" phone jack type: stereo type jacks may be utilized as shown with the extra contact connected as an on-off battery power switch which makes ground contact with the sleeve of a mono type phone plug when the plug is inserted into either jack.

The loudspeaker output drive circuit 130 includes special circuitry including resistor 134 and capacitor 136 which automatically reduces battery current drain when no loudspeaker is connected to receptacle 132B, by interrupting transistor 114D's collector d.c. return, thus reducing transistor 142's base current (and bias power) to zero. With a loudspeaker connected, transistors 114D and 142 act as a Darlington pair to provide the necessary output current, about 2 amperes peak. The loudspeaker current surges are supplied from capacitor 138 which recharges between impulses through resistor 140, holding the peak battery current demand to a low value in the order of 25 mA.

Figure 7:
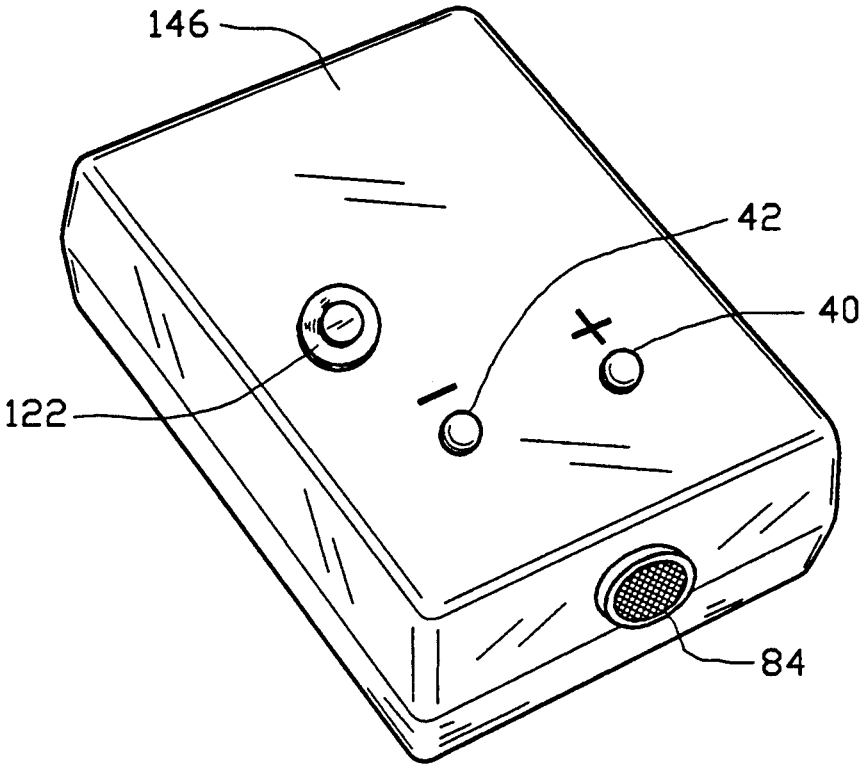
FIG. 7 is a three dimensional view of a phase polarity analyzer of the present invention.

FIG. 7 depicts a phase polarity analyzer instrument of the present invention packaged in a two piece plastic enclosure 146, showing a microphone 84 mounted on a forward facing end, LED 40, typically green, for indicating + phase polarity, LED 42, typically red, for indicating − phase polarity, and a pushbutton switch 122 for controlling power off-on conveniently by thumb pressure while holding the enclosure 146 by hand. Microphone 84 may be of the dynamic or electret condenser type, suitably powered: the required working frequency range is approximately 60 Hz to 3 kHz.

There are several modes in which the phase polarity analyzer and its companion test signal generator of this invention may be utilized. They may be housed in a common enclosure or separate enclosures.

The phase polarity terminal coding of a loudspeaker may be checked by driving the loudspeaker directly with the positive-going impulse from receptacle 132B of the signal generator and monitoring the acoustic signal with the phase polarity analyzer of this invention as described above.

To test an amplifier-speaker combination, the amplifier input is connected to the line output receptacle (132A, FIG. 6) of the test signal generator so as to emit the test impulse acoustically from the loudspeaker, the analyzer is located and activated in front of the loudspeaker to pick up the acoustic output, and will then indicate phase polarity on one or other of the LED'S.

For testing the polarity of a microphone, a test loudspeaker is connected with correct polarity to receptacle 132B so as to be pulsed by the test signal generator; the microphone under test, located in the loudspeaker's acoustic field, is connected to the input of the phase polarity analyzer in place of the regular test microphone. Switching between the instrument's test microphone and a microphone under test may be implemented by a switching jack or a shielded microphone switch in combination with adaptors for different microphone connector types. Such facilities also allow the use of an external test microphone, for example mounted at the end of a boom for checking speakers mounted in high or otherwise inaccessible locations. Similarly, a built-in test loudspeaker and associated changeover switch could be provided in the test signal generator.

The present invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. Audio phase polarity test apparatus, for determining and indicating polarity of a subject signal emanating from an audio channel under test that receives as input a test signal configured as a continuous series of unipolar impulses of designated polarity, rise time and recurrence time interval, wherefrom the audio channel produces the subject signal, said test apparatus including a phase polarity analyzer comprising:

an audio amplifier circuit receiving the subject signal and providing therefrom a reference waveform constituting a scaled replica of the subject signal;

an inverter circuit receiving as input the reference waveform and providing therefrom an inverted waveform constituting an inverted replica of the reference waveform;

first and second level-detection means, identical with each other, receiving as input the reference waveform and the inverted waveform respectively, and each providing as output a trigger signal whenever the respective input instantaneously exceeds a predetermined triggering level;

a flip-flop circuit, having a first input connected to the output of said first level-detection means and having a second input connected to the output of said second level-detection means, said flip-flop circuit being made to response to a trigger signal received at the first input by transitioning to a first latched state for a latched time period during which said flip-flop circuit is rendered unresponsive to said second level-detection means, and similarly to response to a trigger signal received at the second input by transitioning to a second latched state for a latched time period during which said flip-flop circuit is rendered unresponsive to said first level-detection means;

a third level-detection means receiving as inputs the reference and inverted waveforms and providing as output a display-enable pulse whenever instantaneous amplitude of either of the received inputs rises to a predetermined display-enable level substantially greater than the trigger level;

indicating means, operationally coupled to said flip-flop circuit, for indicating polarity as determined by said phase polarity analyzer; and an indicator control circuit block receiving as control input the display-enable pulse from said third level-detection means and providing as outputs a reset signal to said flip-flop circuit and an enabling signal to said indicator means, said indicator control circuit block being made to cause said indicator means to provide a first polarity indication whenever the display-enable pulse occurs within the latched time period initiated by said first level-detection means, and to provide a second and opposite polarity indication whenever the display-enable pulse occurs within the latched time period initiated by said second level-detection means;

whereby said analyzer registers polarity determinations and said indication means displays a thusly registered determination result only if and when the first and second waveforms have been found by said third level-detection means to have a predetermined sufficient working amplitude, thereby providing polarity indication with immunity against erroneous indications from waveform distortions including overshoot and ringing introduced by acoustical transducers.

2. The audio phase polarity test apparatus defined in claim 1 wherein the recurrence time interval of the test signal impulses is made to be in the order of one second and the polarity thereof is made to be positive.

3. The audio phase polarity test apparatus defined in claim 1 further comprising:

a display timing circuit, in said analyzer, acting to cause said display means to sustain each instance of polarity indication for a predetermined display time duration, shorter than the recurrence time interval of the test signal impulses.

4. The audio phase polarity test apparatus as defined in claim 3 wherein the display time duration is made to be in a range between one fourth and three fourths of the recurrence time interval.

5. The audio phase polarity test apparatus as defined in claim 1 wherein said first and second level-detection means comprise:

a first envelope detector receiving as input the reference waveform and providing a first envelope signal constituting a quasi-peak-detected envelope of the reference waveform;

a second envelope detector, identical with said first envelope detector, receiving as input the inverted waveform and providing a second envelope signal constituting a quasi-peak-detected envelope of the inverted waveform;

a first comparator, receiving the first envelope signal as input, made to response thereto at the first triggering level by triggering said flip-flop circuit to the first latched state;

a second comparator, identical with said first comparator, receiving as input the second envelope signal, made to response thereto at the first triggering level by triggering said flip-flop circuit to the second latched state; and a reference voltage source applying to both of said comparitors a d.c. reference voltage that establishes the first 6. The audio phase polarity test apparatus as defined in claim 5 wherein said third level detection means comprises first and second like diodes each having a first terminal connected in common to an enabling input of said indicator control circuitry, said first diode having a second terminal receiving the first envelope signal and said second diode having a second terminal receiving the second envelope signal.

7. The audio phase polarity test apparatus defined in claim 5 further comprising in the analyzer:

positive feedback circuitry associated with the first and second comparators, configured to operate the comparators in a hysteresis loop such that once a comparator is triggered to an "on" state by an envelope signal exceeding the positive or negative sensing level, releasing of the comparator to an "off" state requires the envelope signal to settle below a release level which is lower than the positive and negative sensing levels, in order to unlatch the latch circuit;

whereby an envelope decay time constant of said envelope detectors, acting in conjunction with the comparator hysteresis loop, temporarily sustains any latching of a comparator, thus registering a corresponding polarity determination in the flip-flop for a sufficient latched time period to allow said third level detector, upon determining that the waveform amplitude is sufficient by having risen to the display-enabling threshold level, to initiate a display time cycle and hold the flip-flop locked onto the registered polarity determination for the duration of the display time cycle, and to thus cause the registered polarity determination to be indicated by said display means for the display time duration.

8. The audio phase polarity test apparatus defined in claim 1 wherein said display means comprises, in said analyzer:

a first LED indicating positive polarity as determined by said analyzer; and a second LED indicating negative polarity as determined by said analyzer.

9. The audio phase polarity test apparatus defined in claim 8 wherein said first and second LEDs are made to be green and red in color, respectively.

10. The audio phase polarity test apparatus defined in claim 1, wherein the subject signal is an acoustic output of a loudspeaker which is a final element in the audio channel, the apparatus further comprising:

a test microphone receiving as input the acoustic output of the loudspeaker; and a microphone amplifier, in said analyzer at an input port thereof, receiving as input a signal from said microphone and providing as output the waveform replicating the subject signal.

11. The audio phase polarity test apparatus defined in claim 1 further comprising;

a test generator providing the test signal input to the audio channel under test, the test signal being made to provide an impulse having positive-going leading edge with a rise time less than 100 microseconds, and a recurrence time interval in the order of one second.

12. The audio phase polarity test apparatus defined in claim 11 wherein the test signal is made to be generally triangular in shape and to have a fall time in the order of 40 milliseconds.

13. The audio phase polarity test apparatus defined in claim 11 further comprising;

a first output receptacle of said test generator providing an output test signal designated as a line output and having a peak amplitude in the order of 0.4 volts; and a second output receptacle of said test generator providing an output test signal designated as a speaker output and having a peak output of at least 5 volts when driving a loudspeaker rated at 4 ohms impedance.

14. The audio phase polarity test apparatus defined in claim 13 wherein said test generator is powered from a battery, and wherein said test generator further comprises:

a transistor output stage for driving a loudspeaker via the second output receptacle;

a resistance-capacitance isolation circuit connected between the battery and said output stage, acting to minimize peak battery current demand during impulses; and a base biasing circuit, in said output stage, configured in a manner to substantially minimize power consumed by said output stage in the absence of any loudspeaker connected to said second output receptacle.

15. The audio phase polarity test apparatus defined in claim 11, as utilized to determine phase polarity of a microphone under test, further comprising;

a power output stage in said test generator capable of driving a loudspeaker;

a test loudspeaker, connected to said output stage, providing an acoustic output representing the test signal as an acoustic test input signal to the microphone; and a microphone amplifier receiving input from the microphone under test and providing the replica of the subject signal in said analyzer;

whereby the replica of subject signal may be tested for polarity by said analyzer and a result indicated by said display means.

16. The audio phase polarity test apparatus as defined in claim 10, wherein said analyzer further comprises:

an inverter circuit receiving as input a first waveform, being the waveform replicating the subject signal, and providing a second waveform, being an inverted replica of the first waveform;

a first envelope detector circuit receiving as input the first waveform and providing a first envelope signal, being a quasi-peak-detected envelope of the first waveform; and a second envelope detector circuit, identical with said first envelope detector circuit, receiving as input the second waveform and providing a second envelope signal, being a quasi-peak-detected envelope of the second waveform;

a first comparator receiving as input the first envelope signal;

a second comparator, identical with the first comparator, receiving as input the second envelope signal;

a d.c. reference voltage, applied to said first and second comparators, so as to establish a positive sensing level of the first envelope signal at said first comparator and a negative sensing level of the first envelope at said second comparator;

a flip-flop circuit, driven from said first and second comparators, operating in a manner to register a response from said first comparator for a latched time period during which any response from said second comparator is rendered inconsequential, and similarly to register a response from said second comparator for a latched time period during which any response from said first comparator is rendered inconsequential;

first and second LEDs constituting said display means, driven separately from outputs of said flip-flop circuit, for indicating positive and negative polarity respectively as determined by said analyzer;

a display timing circuit, receiving the first and second envelope signals at a start trigger input, cooperating with said flip-flop circuit and said display means to establish a display time duration in the order of 0.4 seconds upon triggering of the start input which is made to have a triggering threshold such as to establish a display-enable sensing level of the first and second envelopes exceeding the positive and negative sensing levels;

whereby, whenever a polarity is temporarily registered by latching of one of said comparators thus driving said flip-flop circuit to a latched state, if the envelope amplitude exceeds the display-enable sensing level, indicating adequate working amplitude, then said display timing circuit is caused to initiate a display timing cycle during which said flip-flop circuit is held locked and a corresponding one of said LEDs is hold on to indicate polarity as determined.

17. A method of determining input-to-output polarity of an audio system under test including a loudspeaker driven by an amplifier, comprising the steps of:

stimulating the amplifier at an input thereof by a test signal providing a continuous series of unipolar impulses of designated polarity, rise time and recurrence time interval, so as to cause the loudspeaker to emanate a corresponding acoustic signal;

sensing the acoustic signal with a suitably located test microphone connected to an input of an electronic polarity analyzer wherein a method of analyzing a sensed signal thusly received from the microphone comprises the steps of:

deriving from the sensed signal a subject waveform to be analyzed;

analyzing the subject waveform with comparator circuitry for providing responses at predetermined positive and negative sensing levels of a leading edge of the subject waveform and at a predetermined required amplitude level of the subject waveform the required amplitude level being substantially greater than the sensing levels;

upon a comparator response occurring at the positive or negative sensing level, temporarily registering a tentative polarity determination based on which of the two sensing levels responded;

upon a comparator response indicating that the required amplitude level has been satisfied and the tentative polarity determination confirmed, indicating polarity, as confirmed, on display means for a display time period in the order of half of the test signal recurrence time interval;

resetting the comparator circuitry to a ready mode wherein the analyzer is again prepared to analyze a subsequent pulsed waveform and again indicate polarity as determined.

18. A method of determining polarity of an audio channel, through audio signal processing in an electronic polarity analyzer, comprising the steps of:

stimulating the audio channel at an input thereof by test signal providing a continuous series of unipolar impulses of designated polarity, rise time and recurrence time interval;

sensing an output signal of the audio channel at an input port of the phase polarity analyzer; and then, in the analyzer:

deriving from the sensed signal a subject waveform to be analyzed;

analyzing the subject waveform with comparator circuitry for providing responses at predetermined positive and negative sensing levels at a leading edge of the subject waveform and at a predetermined required amplitude level of the subject waveforms the required amplitude level being substantially greater than the sensing levels.

upon a comparator response occurring at the positive or negative sensing level, making and temporarily registering a tentative polarity determination based on which of the two sensing levels responded;

upon a comparator response indicating that the required amplitude level has been satisfied and the tentative polarity determination confirmed, indicating polarity, as confirmed, on display means for a display time period in the order of half of the test signal recurrence time interval;

sensing amplitude of subject waveform relative to a designated resetting level, and, if so;

resetting the comparator circuitry to a ready mode wherein the analyzer is again prepared to analyze a subsequent pulsed waveform and again indicate polarity as determined.

* * * * *